US008523441B2

(12) United States Patent
Goglio et al.

(10) Patent No.: US 8,523,441 B2
(45) Date of Patent: Sep. 3, 2013

(54) PACKAGE OF FLEXIBLE MATERIAL, PARTICULARLY FOR STERILISABLE FOOD PRODUCTS

(75) Inventors: Franco Goglio, Milan (IT); Giorgio Bottini, Gallarate (IT); Roberto Galbasini, Casale Litta (IT)

(73) Assignee: Goglio S.p.A., Milan (IT)

( * ) Notice: Subject to any disclaimer, the term of this patent is extended or adjusted under 35 U.S.C. 154(b) by 960 days.

(21) Appl. No.: 12/576,753

(22) Filed: Oct. 9, 2009

(65) Prior Publication Data

US 2010/0092112 A1 Apr. 15, 2010

(30) Foreign Application Priority Data

Oct. 10, 2008 (EP) ..... 08425661

(51) Int. Cl.

| | |
|---|---|
| ***B65D 33/16*** | (2006.01) |
| ***B65D 33/00*** | (2006.01) |
| ***B65D 65/26*** | (2006.01) |
| ***B65D 43/02*** | (2006.01) |
| ***B65D 43/00*** | (2006.01) |
| ***B65D 17/00*** | (2006.01) |

(52) U.S. Cl.

USPC ..... 383/210; 383/66; 383/80; 383/205; 383/61.1; 229/123.1; 229/245; 229/246; 229/125.15

(58) Field of Classification Search

USPC ..... 383/210, 66, 80, 61.1, 205; 229/123.1, 229/245, 246, 125.15

See application file for complete search history.

(56) References Cited

U.S. PATENT DOCUMENTS

| | | | | |
|---|---|---|---|---|
| 3,394,861 | A * | 7/1968 | Truax | 229/120.07 |
| 3,717,533 | A * | 2/1973 | Mayworm et al. | 156/244.14 |
| 3,893,566 | A * | 7/1975 | Ross | 220/258.2 |
| 4,401,229 | A * | 8/1983 | Bell et al. | 220/258.3 |
| 4,830,273 | A * | 5/1989 | Kalberer et al. | 229/123.1 |
| 4,858,821 | A * | 8/1989 | Bickelhaupt | 229/123.1 |
| 5,370,883 | A * | 12/1994 | Saunier | 426/107 |
| 5,988,371 | A | 11/1999 | Paley et al. | |
| 6,026,953 | A | 2/2000 | Nakamura et al. | |
| 6,231,237 | B1 * | 5/2001 | Geller | 383/119 |
| 6,857,561 | B2 * | 2/2005 | Williams et al. | 229/123.1 |
| 6,881,286 | B2 * | 4/2005 | Drummond et al. | 156/69 |
| 7,004,628 | B2 * | 2/2006 | Morgan | 383/6 |
| 7,921,999 | B1 * | 4/2011 | Kimball | 206/440 |

(Continued)

FOREIGN PATENT DOCUMENTS

| | | |
|---|---|---|
| EP | 1 679 269 | 7/2006 |
| EP | 1 679 270 | 7/2006 |

OTHER PUBLICATIONS

European Search Report dated Jan. 27, 2009, from corresponding European application.

*Primary Examiner* — Nathan J Newhouse
*Assistant Examiner* — Latrice Byrd
(74) *Attorney, Agent, or Firm* — Young & Thompson

(57) ABSTRACT

A package of flexible material, particularly suitable to contain sterilizable food products, has a parallelepiped box shape with a base or bottom wall (2), a top wall (3), a front wall (4), a back wall (5) and two side walls (6, 7), an opening (8) closed by a peelable patch (9) sealed along a track (20) disposed astride the peripheral edge of the opening (8) being provided on the top wall (3), a respective peripheral edge (10) protruding from the base (2) and from the top wall (3).

14 Claims, 3 Drawing Sheets

(56) References Cited

U.S. PATENT DOCUMENTS

| | | | | |
|---|---|---|---|---|
| 8,066,137 | B2 * | 11/2011 | Sanfilippo et al. | 220/6 |
| 2003/0085265 | A1 * | 5/2003 | Haim | 229/123.1 |
| 2004/0114838 | A1 * | 6/2004 | McGregor | 383/204 |
| 2004/0141664 | A1 * | 7/2004 | Olsen et al. | 383/66 |
| 2005/0150785 | A1 * | 7/2005 | Julius et al. | 206/233 |
| 2007/0131750 | A1 * | 6/2007 | Drummond et al. | 229/123.1 |

* cited by examiner

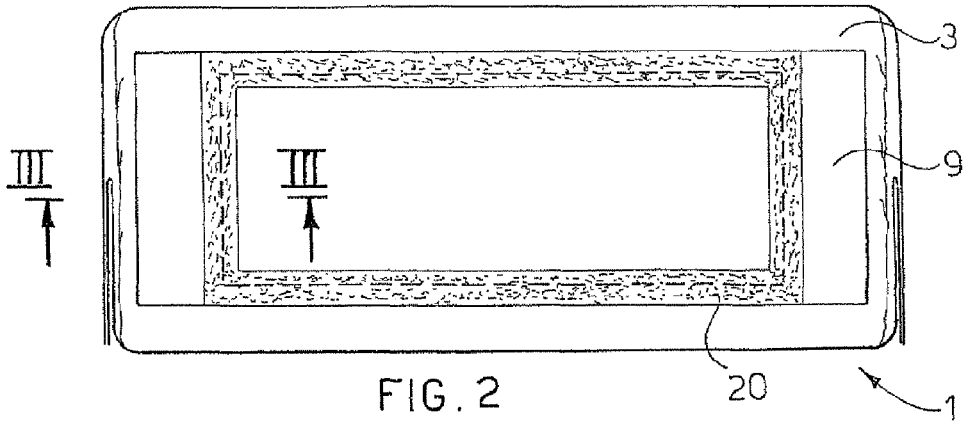
FIG. 2
FIG. 3
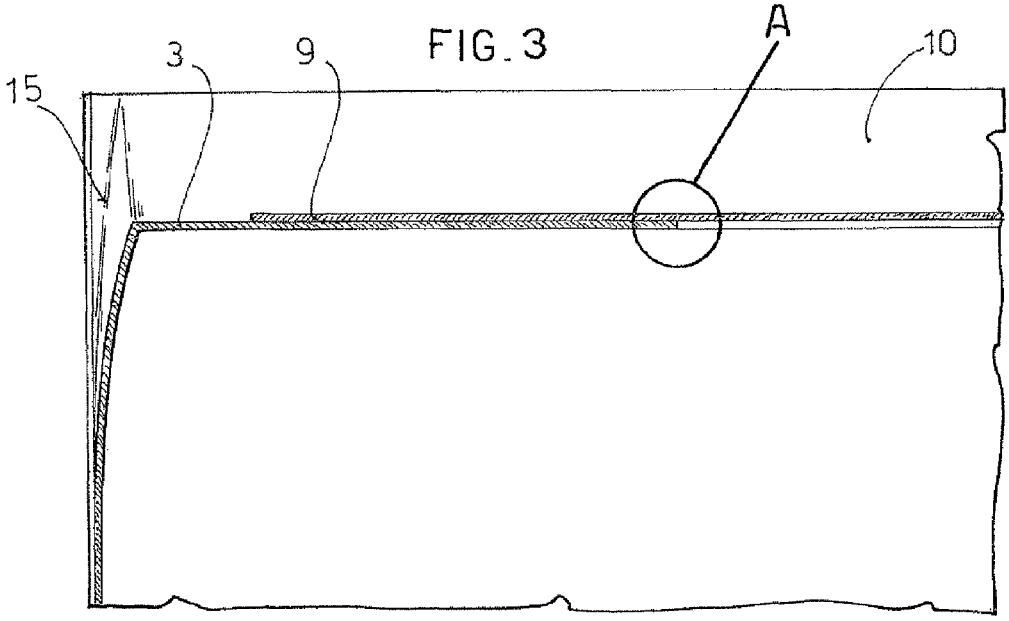
FIG. 4
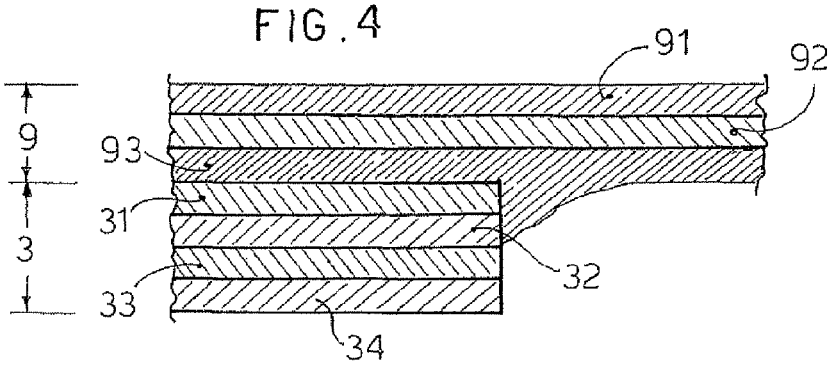

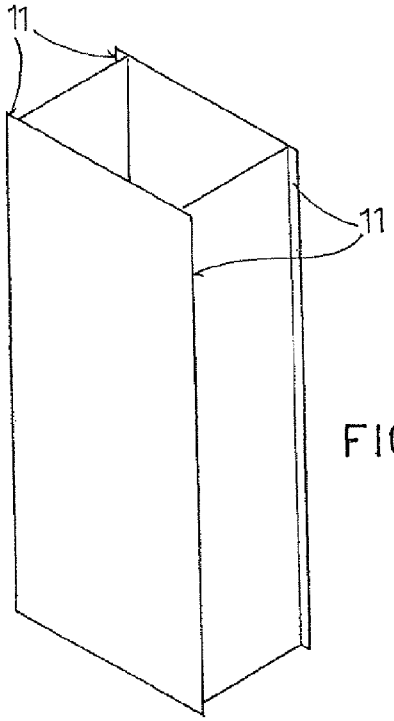
FIG. 5
FIG. 7
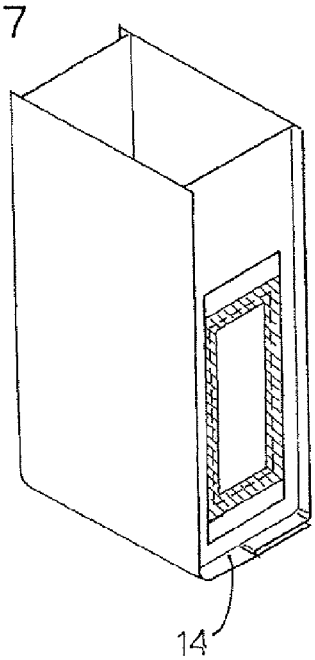
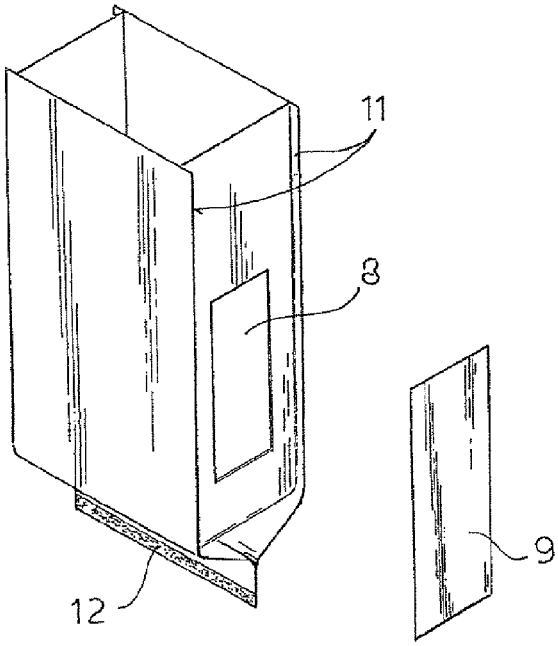
FIG. 6
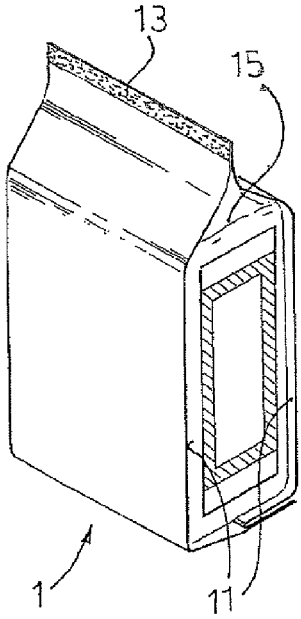
FIG. 8

PACKAGE OF FLEXIBLE MATERIAL, PARTICULARLY FOR STERILISABLE FOOD PRODUCTS

The present invention refers to a package of flexible material particularly suitable for containing food products in a liquid or viscous state or in a solid state with preserving liquid, destined to undergo heat treatments in an autoclave, such as jams, fruit juices and the like. However, the package according to the invention can also be used to to contain granular or solid products not necessarily of an edible type.

To remain in the sector of the liquid, sterilizable food products, at which the invention is aimed particularly, these products are currently packaged in hermetically closed cans or aluminium trays.

These packages hold various drawbacks which range from the relatively high costs to the complexity of the processes for manufacturing and filling the packages, to the difficulties in opening them.

Object of the present invention is to overcome the aforementioned drawbacks by providing a package of flexible material that is simple and cheap to produce, as well as easy to open.

Another object of the invention is to provide such a package that is able to guarantee the absolute sterility of the products contained therein.

These objects are achieved with the package according to the invention, which has the characteristics listed in appended independent claim 1.

Advantageous embodiments of the invention are described in the dependent claims.

Essentially, the package of flexible material according to the invention, having a parallelepiped box shape, has on one face an opening that is closed by a peelable sheet or patch heat-sealed along the perimeter of the opening.

Normally, the material of the flexible package is multilayered and comprises at least one inner layer of aluminium acting as a barrier or another barrier layer, such as a layer of polyester coated with silicon or aluminium dioxide, and likewise the material of the flexible closure patch is multilayered and comprises a peelable inner layer such as to allow a seal of the easy-open type.

In particular, the sealing of the patch to the perimeter of the opening provided in the package takes place along a track that is disposed astride the edge of said opening, so that the heat of the heat-sealing causes a softening of the inner layer of the patch, which "runs" onto the edge of the opening, covering the edge of the layer of aluminium.

In this manner, any contact between the liquid or viscous product contained in the package and the aluminium layer, which could cause oxidation or corrosion, is avoided and the maintenance of the sterile conditions inside the package is ensured.

The flexible package is advantageously obtained from a continuous web which is die-cut in advance at regular distances to obtain the abovementioned openings closed by a patch and is sent to a forming mandrel which can be of the form and fill type, that is, around which the package is formed and filled with product.

In particular, the package according to the invention has four longitudinal seals of the fin-seals type, or even inside-to-inside seals, at the four longitudinal edges of the package, seals which serve to give the package a stiff consistency, one of them also serving to close the web longitudinally, forming a tube.

The package is then completed with two transversal seals and by folding thereof to form a gusset.

In the position of use of the formed package, the above mentioned longitudinal seals are disposed horizontally, forming protruding bottom and top edges, which stiffen the package and allow it to remain in a stable, upright position, with the peelable patch disposed on the upper face.

By way of example, the flexible film of the package according to the invention consists, advantageously, of four layers thus arranged from the outside in: a first layer of cast polypropylene (CPP), of heat-sealing biaxially oriented polypropylene (BOPP) or of heat-sealing polyethylene terephthalate; a second layer of aluminium; a third layer of polyethylene terephthalate or of nylon; a fourth layer of cast polypropylene.

The film of the window-closing patch, on the other hand, can be three-layered comprising, again from the outside in: polyethylene terephthalate, aluminium, cast or peelable polypropylene.

Further characteristics of the invention will be made clearer by the detailed description that follows, referring to a purely exemplifying and therefore non limiting embodiment thereof, illustrated in the appended figures, wherein:

FIG. 2 is a top plan view of the package of FIG. 1, without the lid;

FIG. 3 is a section taken along the line III-III of FIG. 2;

FIG. 4 is an enlargement of the detail indicated with the letter A in FIG. 3;

FIGS. 5 to 8 show diagrammatically successive steps in the manufacturing process of the package according to the invention.

Figure 1:
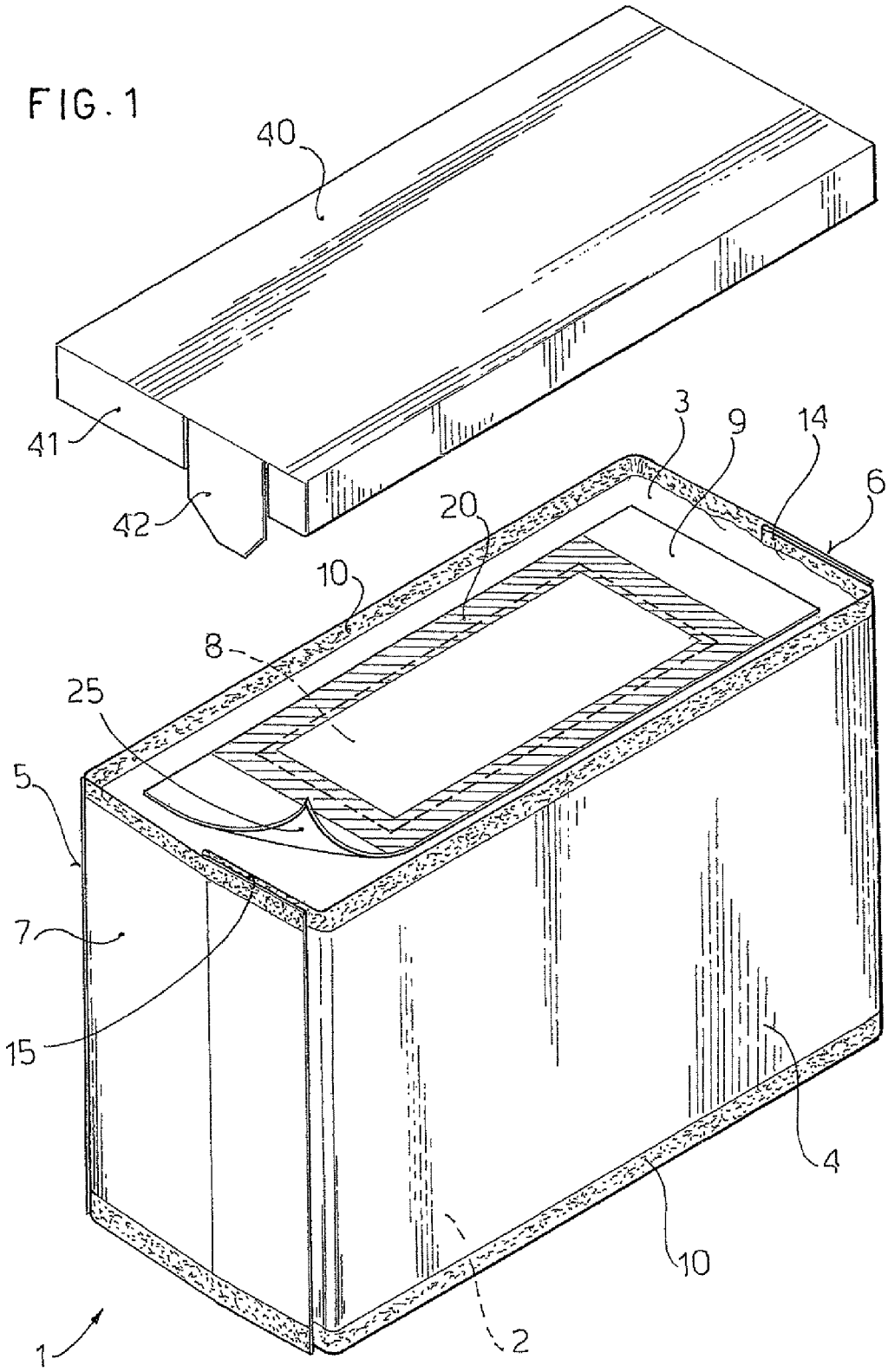
FIG. 1 is an axonometric view of a package according to the invention, shown in the position of use, with a possible closing-again lid.

With reference to said figures, and for now in particular to FIG. 1, reference numeral 1 designates as a whole a package according to the invention, particularly for sterilizable food products in a liquid or semi-liquid state, possibly incorporating solid pieces.

The package 1 has a parallelepiped box shape and has a (rectangular) base 2, a top wall 3, a front wall 4, a back wall 5 and two side walls 6 and 7.

On the top wall 3 a rectangular opening or window 8 is formed, which is closed by a peelable sheet or patch 9, in the way that will be better described later.

Peripherally to the base 2 and to the top wall 3 there is a respective protruding edge 10, obtained by sealing edges of the film making up the package, as will be described later, and serving to give it stiffness and stability.

Of course, in an alternative embodiment the edge 10 may be absent.

A possible manufacturing process for the package according to the invention will now be described with reference to FIGS. 5 to 8, to be understood as purely schematic. In fact, in said figures, and in particular in FIG. 6, the step of forming the window 8 and of closing it with the patch 9 is shown when the package is practically already formed and only the closure thereof is lacking. In fact, the windows 8 are advantageously die cut on a web of sheet material at regular distances and closed by the patches 9 before forming the package, that is, before the representation shown in FIG. 5, in which the web of material has been closed to form a tube and shown diagrammatically already cut to the right length to form the package 1.

As shown in FIG. 1, four longitudinal seals 11 of the fin-seal type, in which inner edges of the film are brought into contact and sealed to each other, are made on the web of material, which is made to advance along a mandrel, normally disposed vertically. One of these longitudinal seals 11, shown in bold in FIG. 5 to distinguish it from the others, closes the web of sheet material to form a tube.

A bottom transverse seal 12 is then made (FIG. 6), which closes the tube at the bottom, followed by a gusset fold 14 (FIG. 7) and lastly by a further top transverse seal 13 and by a subsequent gusset fold 15 (FIG. 8) to close the package.

In the practice, if the mandrel around which the packages 1 are formed is of the form and fill type, in which the package is filled during the forming, when the transverse seal 13 is made to close the package, the bottom transverse seal 12 is made at the same time on the package immediately following, which is then separated by cutting it from the preceding one.

The formed package is then placed in the position of use as shown in FIG. 1, wherein the abovementioned longitudinal seals 11 form the top and bottom protruding peripheral edges 10 of the package 1, with the two gusset folds 14 and 15 which are disposed to form the respective side walls 6 and 7.

With reference now particularly to FIGS. 1 to 4, the method of application of the patch 9 to close the opening 8 is better described.

As shown by the area in grey on FIGS. 1 and 2, the patch 9 is sealed peelably to the top wall 3 of the package 1 along a sealing track 20 which is disposed astride the peripheral edge of the opening 8. In this manner, the heat to which the area of the patch 9 is subjected during the heat-sealing causes the softening of the material in the area of the sealing track 20 not overlying the wall 3 beneath and said material covers the inner edge of the opening 8.

This situation is schematised, in an exaggerated manner, in the enlarged section of FIG. 4, where the flexible film of the package 1 is shown as a laminate with four layers and the film of the peelable patch 9 as a laminate with three layers.

In particular, by way of example, working from the outside in, and thus from thee top to the bottom with reference to FIG. 4, the film of the package comprises a first layer 31 of cast polypropylene (CPP), of heat-sealing biaxially oriented polypropylene (BOPP) or of heat-sealing polyester (PET); a second layer 32 of aluminium; a third layer 33 of polyester or of nylon and a fourth layer 34, again of cast polypropylene.

The film of the patch 9, on the other hand, comprises, again from the outside in, that is from the top to the bottom, a first layer 91 of polyester, a second layer 92 of aluminium and a third layer 93 of peelable cast polypropylene.

As shown diagrammatically in FIG. 4, the melting of the layer 93 of CPP of the patch 9 during the heat-sealing produces an "overflow" of this material onto the inner edge of the opening 8, and in particular the covering of the layer of aluminium 32, preventing the contact of the content of the package 1 with the edge of the layer of aluminium, and thus preventing possible oxidations or corrosions, which would harm the sterility of the content of the package.

As stated previously, in fact, the package according to the invention is particularly suitable to contain sterilisable products, namely products which, after the packaging, can be subjected to heat treatment in an autoclave.

Therefore, the materials of the flexible films used for the package 1 and for the patch 9 are chosen so as to withstand high sterilisation temperatures.

If the package does not have to be subjected to heat treatments, that is if it is destined to contain non sterilisable products, polyethylene can be used for the various layers of films instead of polypropylene or of polyester.

FIG. 1 shows diagrammatically how the opening of the package 1 takes place by raising and by puling an edge 25 of the patch 9 and by removing said patch thanks to the peelability of the heat seal along the track 20.

Once the patch 9 has been removed, the contents of the package 1 can be consumed even by taking them directly from the package, for example using a spoon.

Optionally, a lid 40 to cover the package 1 can be provided on the top wall 3 where the patch 9 is provided, for reasons of hygiene, and possibly to close the package again in the event of a partial use of its contents.

The lid 40 shown in FIG. 1 consists of a rectangular wall reproducing the shape of the top wall 3 of the package 1, with a downward-facing peripheral edge 41, which surrounds the protruding upper edge 10 of the package.

The seal of the lid is ensured by two opposite facing tongues 42 (only one can be seen in FIG. 1) which are inserted in the respective fan folds 14 and 15 provided at the side walls 6 and 7 of the package.

The lid 40 can be made of cardboard, of plastic or of other materials. It could possibly be made of a heat-shrinkable plastic material that adheres on the outside to the upper peripheral edge 10 of the package.

It is clear, however, that the invention is not limited to the particular embodiment previously described and illustrated in the appended figures, but numerous modifications of detail within the reach of a person skilled in the art can be made thereto without thereby departing from the scope of the invention, as set forth in the appended claims.

The invention claimed is:

1. A package (1) of flexible material, for foodstuffs, comprising:

a first flexible film defining a parallelepiped box having, in a position of use, a base or bottom wall (2), a top wall (3), a front wall (4), a rear wall (5) and two side walls (6, 7), an opening (8); and a second flexible film defining a peelable patch (9) on one of said walls, the peelable patch (9) closing the opening (8), wherein, the peelable patch (9) is peelably heat sealed to said wall of the package along a sealing track (20) which is disposed astride a peripheral edge of said opening (8), and wherein said peripheral edge of said opening (8) is defined by a first surface portion heat-sealed to an inner surface of the patch (9) and a second adjoining cross-section portion, the second cross-section portion is covered by a heat-seal overflow of a material (93) of the inner surface of the patch (9), which overflow of material (93) runs from the first surface portion and along the second cross-section portion at an area of the sealing track (20) not superimposed on the wall of the box during heat sealing so as to avoid contact of contents of the package with said edge of the opening (8).

2. A package according to claim 1, wherein, said opening (8) closed by the peelable patch (9) is provided on said top wall (3).

3. A package according to claim 2, wherein, said peripheral edge of said opening (8) is covered by the material of the inner surface of the patch (9) which runs from the area of the sealing track (20) not superimposed on the wall of the parallelepiped box during heat sealing so as to avoid the contact of the contents of the package with said edge of the opening (8).

4. A package according to claim 1, wherein, said bottom wall (2) and said top wall (3) have a respective protruding peripheral edge (10).

5. A package according to claim 4, wherein, said protruding peripheral edges (10) of the bottom and top walls (2, 3) of the parallelepiped box are obtained by respective pairs of longitudinal seals (11), of a fin seals type, made during the package forming process, transverse seals (12, 13) with subsequent gusset folds (14, 15) being disposed on the side walls (6, 7) of the package.

6. A package according to claim 4, wherein, a lid (40) is provided to cover said top wall (3).

7. A package according to claim 6, wherein, said lid (40) has a downward protruding peripheral edge (41), surrounding said protruding peripheral edge (10) of the top wall (3).

8. A package according to claim 7, wherein, said lid (4) has two opposite facing tabs (42) adapted to be inserted in respective gussets (14, 15) of the side walls (6, 7) of the package.

9. A package according to claim 1, wherein, the first and second flexible films making up the parallelepiped box and the patch (9) are each multilayer films comprising at least one inner layer of aluminium or another barrier layer, and heat-sealing layers on contact, at least one of them being of a peelable type.

10. A package according to claim 9, wherein, the first flexible film of the parallelepiped box comprises, from the outside in, a first layer (31) of cast polypropylene, of heat-sealing biaxially oriented polypropylene or of heat-sealing polyester; a second layer (32) of aluminium; a third layer (33) of polyester or of nylon and a fourth layer (34) of cast polypropylene, whereas the second flexible film of the patch (9) comprises, again from the outside in, a first layer (91) of polyester; a second layer (92) of aluminium and a third layer (93) of peelable cast polypropylene, the third layer being the overflow of material (93).

11. A package according to claim 1, wherein said box and patch are suitable for containing food products in one of a liquid state, a viscous state, and a solid state with preserving liquid, the package and contained food destined to undergo heat treatments in an autoclave, the box and patch suitable to withstand sterilisation temperatures.

12. A package according to claim 1, wherein said peripheral edge of said opening (8) is comprised, from the outside in, a first layer (31) of cast polypropylene; a second layer (32) of aluminium; a third layer (34) of cast polypropylene, and the patch (9) comprises, from the outside in, a first layer (91) of polyester; a second layer (92) of aluminium and a third layer (93) of peelable cast polypropylene, the third layer being the overflow of material (93), and the third layer (93) of the patch (9) covers the first layer (31) of cast polypropylene and the second layer (32) of aluminium of the second cross-section portion of the peripheral edge of said opening (8).

13. A package according to claim 1, wherein said peripheral edge of said opening (8) is comprised, from the outside in, a first layer (31) of polypropylene; a second barrier layer (32); a third layer (34) of polypropylene, and the patch (9) comprises, from the outside in, a first layer (91) of polyester; a second barrier layer (92) and a third layer (93) of peelable polypropylene, the third layer being the overflow of material (93), ands the third layer (93) of the patch (9) covers the first layer (31) and the second barrier layer (32) of the second cross-section portion of the peripheral edge of said opening (8).

14. A package according to claim 1, wherein said peripheral edge of said opening (8) is comprised, from the outside in, a first layer (31); a second barrier layer (32); a third layer (34), and the patch (9) comprises, from the outside in, a first layer (91); a second barrier layer (92) and a third layer (93) of peelable polypropylene, the third layer being the overflow of material (93), and the third layer (93) of the patch (9) covers the first layer (31) and the second barrier layer (32) of the second cross-section portion of the peripheral edge of said opening (8).

* * * * *